United States Patent [19]

Prinz et al.

[11] Patent Number: 4,739,989

[45] Date of Patent: Apr. 26, 1988

[54] TENNIS BALL

[75] Inventors: Martin Prinz, Holzkirchen; Wolfgang Potutschnig, Gmund, both of Fed. Rep. of Germany

[73] Assignee: Intercon Markenartikel Fabrikation und Vertrieb GmbH, Augsburg, Fed. Rep. of Germany

[21] Appl. No.: 797,907

[22] Filed: Nov. 14, 1985

[30] Foreign Application Priority Data

Mar. 5, 1985 [DE] Fed. Rep. of Germany ... 8506296[U]
Sep. 20, 1985 [DE] Fed. Rep. of Germany ..... 3533640

[51] Int. Cl.[4] ..... A63B 69/38

[52] U.S. Cl. ..... 273/29 A; 273/61 R; 273/DIG. 20

[58] Field of Search ..... 273/61 R, 61 D, DIG. 20, 273/61 C, 58 B, 58 BA, 65 E, 65 EC, 65 ED, 29 A

[56] References Cited

U.S. PATENT DOCUMENTS

| | | | |
|---|---|---|---|
| 902,330 | 10/1908 | Rowley | 273/61 R |
| 1,653,893 | 12/1927 | Eden | 273/DIG. 20 X |
| 1,684,557 | 9/1928 | Saunders | 273/61 A |
| 1,833,478 | 11/1931 | Williams et al. | 273/61 R |
| 2,012,283 | 8/1935 | Miller | 273/61 D |
| 2,020,612 | 11/1935 | McGrath et al. | 273/61 R |
| 3,888,347 | 6/1975 | Kramer | 273/61 D |
| 4,098,504 | 7/1978 | Koziol et al. | 273/61 R |
| 4,327,912 | 5/1982 | Hoffman | 273/61 D X |
| 4,358,111 | 11/1982 | Papinsick et al. | 273/61 R |
| 4,439,471 | 3/1984 | Lacoste et al. | 273/61 R X |
| 4,596,389 | 6/1986 | Frankowski | 273/61 R |

FOREIGN PATENT DOCUMENTS

| | | | |
|---|---|---|---|
| 719467 | 12/1954 | United Kingdom | 273/58 B |

*Primary Examiner*—George J. Marlo
*Attorney, Agent, or Firm*—Schwartz, Jeffery, Schwaab, Mack, Blumenthal & Evans

[57] ABSTRACT

A tennis ball comprised of a shell and cover, the ball having increased deformation for beginner's play and being characterized by the ball being between 30 and 52 grams in weight and 5.0 to 7.6 centimeters in diameter. The wall thickness of the shell is between 1.2 and 2.8 millimeters.

8 Claims, 1 Drawing Sheet

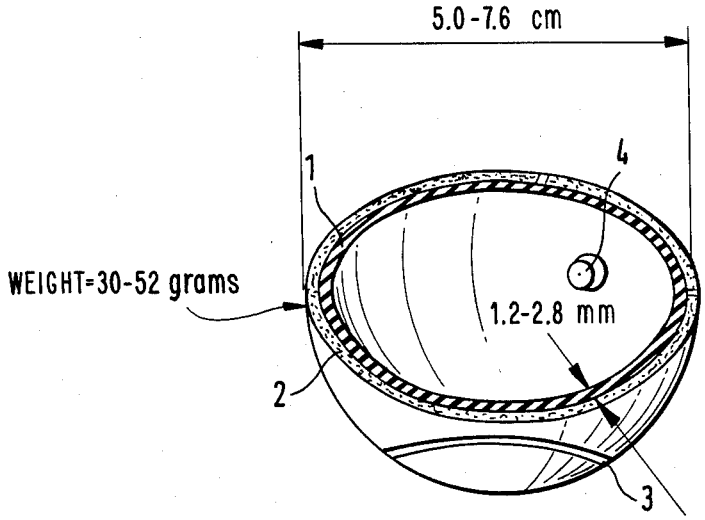
5.0-7.6 cm
1
4
WEIGHT=30-52 grams
1.2-2.8 mm
2
3

TENNIS BALL

The invention is directed to a tennis ball.

Tennis balls used at international events must meet the requirements of the International Tennis Federation (ITF).

More in detail, the tennis balls must have the following properties:

1. The diameter of the tennis ball must be between 6.35 and 6.67 cm at predetermined temperature and humidity conditions.
2. In accordance with the regulations the overall weight of the tennis ball is between 56.7 and 58.5 g.
3. When the tennis ball is dropped from a height of 2.54 m upon a concrete base, a bound of from 1.35 to 1.47 m must be achieved.
4. When loaded with a predetermined weight, the deformation of the tennis ball must not exceed given limit values. These deformations are determined with the "Stevens machine". For the forward deformation (also called "upward deformation") determined in accordance therewith, a range of from 5.6 to 7.4 mm is permissible, and for the return deformation a range of from 8.8 to 10.8 mm is permissible.

The tennis balls consist predominantly of a shell of vulcanized rubber having a layer of felt-like fibrous material glued thereon. With most of the commercially available tennis balls the interior of the shell is filled with a pressure gas, the internal pressure being higher than atmospheric pressure. Furthermore, there are also pressureless balls in which the required bound is achieved due to the fact that the wall thickness of the rubber shell is increased as compared to the gas-filled balls, and/or the shell material has increased stiffness.

The known tournament balls have the drawback that the speed and momentum developed thereby are too high for beginners and in particular for children, so that an unskilled player will have difficulty in striking the ball at the proper time and place.

For this reason foamed balls have been developed for children's tennis, in which the entire volume of the ball is filled with a foam. It is true that these balls rapidly lose speed during flight so that they are slower than normal tennis balls, and because of the reduced weight they also have less momentum; on the other hand the spin behaviour of these balls is rather inferior because—other than with the tournament balls—the overall mass of the ball is not concentrated in an external shell but is evenly distributed across the entire ball diameter. Consequently, the balls have inferior flight characteristics and are particularly wind-sensitive. Also, these foam balls must be struck with far more power than a normal tennis ball and even during a calm have a broken flight path, whereby they differ greatly from the tournament balls. On account of these serious differences in the flight behaviour these balls are unsuited to lead the beginner gradually towards playing with a normal tournament ball. Finally, the bouncing properties of these balls are undesirable, because with their smooth or foam surfaces they are not adapted to the ground conditions prevailing in tennis.

Furthermore, balls have been developed for children's tennis which, while having the same weight as tournament balls, have a considerably increased diameter and are thereby exposed to increased air friction so that they decelerate more quickly. This, however, also entails the drawback that they are highly wind-sensitive. Moreover, the conventional balls intended for children's or beginners' tennis have the drawback that they differ greatly from the usual tournament balls as to their external design, so that spectators will immediately recognize them as being "beginner's balls". This is an added psychologic impediment to the use of such balls.

It is therefore the object of the present invention to provide a tennis ball which is similar to normal tournament balls in respect of its external design while upon being struck and after bouncing it reaches a lower velocity so that it may be more readily controlled by beginners in play.

The above-specified object is solved by means of a tennis ball comprising a shell of elastic material provided on the outside with a layer of felt-like material and having an outer diameter of from 5.0 to 7.6 cm, the overall weight of the ball being between 30 and 52 g.

A tennis ball composed in accordance with the invention has outer dimensions and also an external shape similar to those of normal tennis balls, because like the latter it is provided with a felt layer. It is therefore not readily recognizable as a "beginner's ball".

In contrast to the tournament balls it has reduced weight, which is achieved by the wall thickness of the shell being reduced as compared to that of tournament balls. The reduction in the wall thickness is of advantage for the desired purpose, because thereby the overall weight of the ball is decreased and also the bound of the ball is reduced. Consequently, there result a reduced flight velocity and increased deceleration of the ball after bouncing, so that it can more easily be handled by children and beginners. On account of the reduced weight, which is about 35 to 45 g, less physical strength is necessary to strike the ball. Due to the reduced wall thickness of the shell the ball is more highly deformed upon bouncing, whereby more kinetic energy is absorbed; therefore it bounces away less rapidly. As compared to a play with normal tennis balls, children are able to achieve three to four times longer exchanges of strokes, which almost permits normal playing. Since the tennis ball is otherwise similar to a standard tournament ball, it almost approaches the behaviour of a slowly played normal tennis ball as regards wear, sensitivity to wind, spin characteristic, flight path upon being struck, and the state after bouncing. Even good tennis players may play normally with such a ball across a standard-size court; after the stroke and after the bounce the flight of the ball will only be somewhat slower than with tournament balls.

Like tournament balls, the tennis ball according to the invention may be filled with pressure gas or may be a pressureless ball. As compared to the pressure gas-filled tournament balls, its wall thickness is greatly reduced and is between 1.4 and 2.2 mm, preferably about 1.7 mm, whereas normal pressure gas-filled tournament balls have a wall thickness between 3 and 3.5 mm. When the tennis ball according to the invention is a pressureless ball, it has a wall thickness of about 2.2 to 2.7 mm, whereas pressureless tournament balls have a wall thickness of about 4.6 mm. The shell consists of vulcanized rubber material having natural rubber as its main component; the further components are substantially sulphur, zinc oxide ($ZnO_2$) and titanium oxide ($TiO_2$).

Preferably, the wall thickness w of the shell is calculated in accordance with the formula $$w = R - \sqrt[3]{R^3 - \frac{3(M-G)}{4\pi S}}$$

wherein R is the outer radius of the shell in terms of cm and is between 2.5 and 3.8, G is the weight of the felt-like layer applied to the shell in terms of g, S is the specific gravity of the shell material in terms of g/cm$^3$, and M is the weight of the ball in terms of g and is between 30 and 52.

In accordance with an especially preferred embodiment of the invention a protruberance of flexible material is provided on the inside of the shell. This protruberance functions as a valve. When a hollow needle somewhat corresponding to a hypodermic needle is introduced through said protruberance, pressure gas may be applied to the ball. After withdrawal of the needle the passage will close due to the flexibility of the material of the protruberance and the action of the internal pressure, and the gas is prevented from escaping. The height of the protruberance preferably exceeds the diameter thereof, so that good sealing is obtained.

Below, the invention will be described and explained in detail with reference to the embodiment thereof shown in the drawing.

The FIGURE is a perspective view of one half of a cut-open tennis ball according to the invention. 1 indicates the shell of vulcanized rubber material; this is the cross-hatched portion. 2 indicates the felt layer glued thereon, 3 indicates the cord-like rubber bond between the two tongue-like felt portions. In this embodiment, the wall thickness of the shell is 1.7 mm. The hollow interior space of the ball is inflated at a pressure of about 0.05 to 0.3 bar, preferably of 0.1 to 0.15 bar. By suitable selection of the pressure it is possible to adjust the bound of the ball for a given wall thickness. Suitable pressure gases are, for instance, sulphur hexafluoride and chlorinated hydrocarbons, because there will be only little diffusion through the material of the shell (vulcanized rubber). The figure shows the protruberance 4 projecting towards the inside of the shell and serving as a valve. This protruberance consists of a very soft and somewhat sticky rubber or plastic material so that it will close completely and hermetically after having been pierced with a gas supply needle.

The forward deformation was determined in accordance with the measuring method prescribed by ITF regulations by means of the Stevens machine. To this end a load of 8.165 kg (18 lbs) is placed on the ball, and the resulting deformation is measured. For the embodiment, this was c.2.4 cm.

The return deformation is determined in accordance with ITF regulations by initially loading the ball to such an extent that the deformation thereof will be 2.54 cm (1"). Thereupon the load is reduced to 8.165 kg (18 lbs). The then existing deformation is the return deformation; due to the higher previous load it is greater than the forward deformation. Since the ball according to the invention has a great forward deformation, between 1.20 and 2.80 cm, it was not possible to measure the return deformation in accordance with the ITF measuring method, because after a deformation by 2.54 cm the ball due to its softness is incapable of lifting a load of 8.165 kg. In order to enable comparative values, the ball was deformed to a greater extent than according to the ITF method for measuring the return deformation, viz. by 3.25 cm. The deformation values between 1.5 and 3.1 cm, existing upon reduction of the load to 8.165 kg are the values for the return deformation specified in the patent claims. In the embodiment, this was 2.65 cm.

The bound of the ball according to the embodiment was 0.9 m, and is in the range of 0.8 to 1.2 m.

What is claimed is:

1. A tennis ball, comprising:

(a) a shell of elastic material enclosing an interior space;

(b) a layer of substantially felt-like material applied to the outer surface of said shell, and wherein (c) the overall weight of said ball is between 30 and 52 grams;

(d) the forward deformation of said ball is between 1.2 and 2.8 cm under a loading force of 8.165 kg, and the return deformation is between 1.5 and 3.1 cm after it has been deformed to 3.25 cm under a loading force of 8.165 kg;

(e) the outer diameter of said ball is between 5.0 and 7.6 cm, and (f) the wall thickness of said shell is between 1.2 and 2.8 mm.

2. A tennis ball as claimed in claim 1, characterized in that the weight of the ball is between 35 and 49 g.

3. A tennis ball as claimed in claim 1, characterized in that the diameter of the ball is between 5.8 and 6.7 cm.

4. A tennis ball as claimed in claim 1, characterized in that said shell is made of vulcanized rubber material.

5. A tennis ball as claimed in claim 1, characterized in that the wall thickness of the shell is between 1.4 and 2.2 mm.

6. A tennis ball as claimed in claim 1, said ball being made by a process of manufacturing in which the wall thickness w of the shell is calculated in accordance with the formula $$w = R - \sqrt[3]{R^3 - \frac{3(M-G)}{4\pi S}},$$

wherein R is the outer radius of the shell in terms of cm and is between 2.5 and 3.8, G is the weight of the felt-like layer applied to the shell in terms of g, S is the specific gravity of the shell material in terms of g/cm$^3$, and M is the weight of the ball in terms of g and is between 30 and 52.

7. A tennis ball as claimed in claim 1, wherein the bound of said ball is between 0.8 and 1.2 m.

8. A tennis ball as claimed in claim 1, wherein the forward deformation of the ball is between 2.0 and 2.8 cm under a loading force of 8.165 kg, and the return deformation is between 2.4 and 3.1 cm after it has been deformed to 3.25 cm under a loading force of 8.165 kg.

* * * * *